US008955300B2

(12) United States Patent
Lo et al.

(10) Patent No.: US 8,955,300 B2
(45) Date of Patent: Feb. 17, 2015

(54) FLEXIBLE CONNECTORS

(71) Applicant: Whatino, Inc., Cupertino, CA (US)

(72) Inventors: Yung-Cheng Lo, Cupertino, CA (US); Yung-Fen Lo, Cupertino, CA (US); Ching-Fu Lo, Cupertino, CA (US)

(73) Assignee: Whatino, Inc., Cupertino, CA (US)

( * ) Notice: Subject to any disclaimer, the term of this patent is extended or adjusted under 35 U.S.C. 154(b) by 0 days.

(21) Appl. No.: 14/152,981

(22) Filed: Jan. 10, 2014

(65) Prior Publication Data

US 2014/0230399 A1 Aug. 21, 2014

Related U.S. Application Data

(60) Provisional application No. 61/751,480, filed on Jan. 11, 2013.

(51) Int. Cl.

| | |
|---|---|
| ***F16G 13/18*** | (2006.01) |
| ***A44C 5/02*** | (2006.01) |
| ***A44C 5/10*** | (2006.01) |

(52) U.S. Cl.

CPC ... *A44C 5/10* (2013.01); *Y10S 59/90* (2013.01)
USPC ..... 59/80; 59/78; 59/82; 59/85; 59/93; 59/900

(58) Field of Classification Search

CPC ..... F16G 13/18; F16G 13/24; A44C 5/02; A44C 5/04; A44C 5/08
USPC ..... 59/78, 79.1, 80, 82, 84, 85, 93, 900
See application file for complete search history.

(56) References Cited

U.S. PATENT DOCUMENTS

| | | | | |
|---|---|---|---|---|
| 4,448,017 | A * | 5/1984 | Stark | 59/80 |
| 6,055,802 | A * | 5/2000 | DiVietri | 59/80 |
| 6,339,922 | B1 * | 1/2002 | Foster | 59/80 |
| 6,837,037 | B2 * | 1/2005 | Willinger | 59/85 |
| 8,215,094 | B2 * | 7/2012 | Wienke et al. | 59/84 |
| 8,296,983 | B2 * | 10/2012 | Padgett et al. | 59/80 |
| 8,418,434 | B1 * | 4/2013 | Carruth et al. | 59/83 |

* cited by examiner

*Primary Examiner* — David B Jones
(74) *Attorney, Agent, or Firm* — Sam L. Nguyen; Hamilton, DeSanctis & Cha, LLP

(57) ABSTRACT

In one embodiment, the present application discloses a linker comprising a linker body having a first end and a second end, wherein the first end is configured with a first slot, wherein the second end is configured with a second slot, wherein the first slot is configured to form a reversible connection with the second slot or a third slot or a protrusion and wherein the linker, the linker body and the slot comprise of material selected from silicone or a silicone composite.

11 Claims, 4 Drawing Sheets

FLEXIBLE CONNECTORS

BACKGROUND OF THE INVENTION

Bands and bracelets are usually made from one continuous piece of material which can be a single solid band or a chain of interlocking rings with open ends that are closed by clasp or other small, complicated connecting structure, i.e., a connector. The existing designs for commercially available connectors or linkers are uniformly unimaginative in their shape, forms and compositions. The connector or linker can be a fastener, a hook and an eye or a snap that can only be joined by troublesome fastening or unfastening. Additionally, the connector is often very small and has a complicated structure. If the connector breaks, remedial options can be a complete and expensive replacement involving a jewelry repairperson or discarding the band or bracelet due to the cost of the repair. Currently available band or bracelet also comes in fixed length and produces a fixed diameter. The wearer must permanently cut a segment of oversize band or bracelet to fit the wearer's own comfortable size. Further, no connector currently exist that allows the wearer to easily close the band or bracelet, while expressing or displaying a personal taste, such as a symbol for sport, nature, space exploration, animal or other interests by incorporating an object exemplifying such interest into the connecting assembly. Additionally, no connector or linker currently exists that allows the wearer to combine the linkers to establish secure yet reversible connection, thereby configuring multiple objects from the linkers. It would be desirable to provide an improved flexible connector for bands or bracelets. It would be also desirable to provide an improved flexible linker or connector for toys or DIY toys.

SUMMARY OF THE INVENTION

While many fasteners or clasps or hooks are available in bands or bracelets, there is a need for a flexible, easy to use and cost effective connector for bands or bracelets. Similarly, there is a compelling need that allows the wearer a prominent place to display a preferred object of passion or pursuit, or useful objects as disclosed herein. The present invention satisfies these unmet needs by providing novel designs that comprise a flexible connecting assembly that allows the wearer to readily utilize the connecting assembly, and an optional band or bracelet to form a wearable band or bracelet. The present invention also allows for ease of replacement, interchangeably of components and cost efficiency if and when the wearer wishes to have connecting assembly replaced, updated or exchanged. The connecting assembly may be used to carry or store personal and safety or security items. The following embodiments, aspects and variations thereof are exemplary, illustrative, and are not intended to be limiting in scope.

In one aspect of the invention, there is provided a connecting assembly for connecting a wearable band comprising at least one connector body, the connector body comprising a top face, a bottom face and a side; at least one linker, the linker comprising a proximal end and a distal end, the distal end comprising a protrusion (or a bulge); at least one slot, wherein the slot is configured on the connector body or configured on the linker; wherein the proximal end of the linker may be removably connected to the connector body; wherein the slot on the connector body or on the linker is configured to accept the protrusion to reversibly connect the distal end of the linker to the connector body or to the slot on the linker; and wherein the linker and the connector body comprise silicone or a silicone composite. As disclosed herein, the invention provides a connecting assembly for connecting a linker with the connector body for forming a wearable band so that a protrusion and/or the slot may be designed and configured interchangeably either on the linker or the connector body.

In one aspect, there is provided a connecting assembly, wherein the connector body comprises of at least one, two, three or four slots for accepting a plurality of protrusions. As disclosed herein, the connection formed by the insertion of a protrusion into a slot forms a reversible connection that cannot be readily dislodged or disconnected under normal wearing conditions, but the connection may be disconnected by urging the protrusion back out from the flexible slot. In one aspect, the protrusion is formed such that the diameter or circumference of the protrusion is larger than the slot in which the protrusion may be inserted into, and the protrusion must be urged, forced, compressed or otherwise deformed to fit snugly into or through the slot so as not to be readily dislodged without force. Because the protrusion and the slot is a silicone or a silicone composite, both elements are flexible and deformable, and form a tight connection when linked together. At the same time, the connection is also reversibly disconnected by pulling on the linker and/or deformedly or compressibly pushing and urging the protrusion out of the slot.

In another aspect, there is provided a connecting assembly, wherein the connector body is substantially hollow or solid. In another aspect, there is provided a connecting assembly, wherein the connector body is substantially spherical or semi-spherical, substantially rectangular or semi-rectangular, or substantially oval or semi-oval. In one embodiment, the connector body is a dome or a half-dome. In another embodiment, the connector body further comprises a skirt that is attached to the connector body and radially projects from the connector body. In various embodiments of the above, the connector body may be hollow or solid.

In one aspect, there is provided a connecting assembly, wherein the connector body is substantially flat or planar. In another aspect, there is provided a connecting assembly, wherein the connector body is configured to accept a decal or an image; or where the connector body is configured to be molded (manufactured by extrusion, mold etc . . . ) in a surface texture for the particular object as disclosed herein. In one embodiment of the above, the connector body may be configured to accept printing comprising words or phrases or slogans. In another embodiment, the connector body may be configured to accept patterns, decaling, etching, engraving, debossing or embossing.

In another aspect, there is provided a connecting assembly, wherein the top face is convex and the bottom face is concave. In one embodiment of the above, the top face may be concave and the bottom face may be convex. In another embodiment, the top and bottom face both may be substantially flat. In one particular embodiment, the connector body the top face is concave and the bottom face is convex, wherein the top face further comprises a lip that is directed centripetally.

In one aspect, there is provided a connecting assembly, wherein the connector body is modeled as a sport accessory or equipment, and wherein the connector body is further configured with at least one, two, three or four slots for accepting a plurality of protrusions. In one variation, the connector body is configured with at least five, six, seven, eight or more slots. In one embodiment of the above, the connector body is selected from a group consisting of a basketball, a semi-basketball, a baseball bat, a tennis racquet and swimming goggles. In another embodiment, the connector body is a baseball, a golf ball, a soccer ball, a football, a volley ball, a tennis ball or any semi-ball thereof.

In another aspect, there is provided a connecting assembly, wherein the connector body is modeled as an animal or an insect, and wherein the connector body is further configured with at least one, two, three, or four slots for accepting a plurality of protrusions. In one embodiment of the above, the connector body is selected from a group consisting of a bird, a ladybug, a butterfly, a horse, a sea lion, a dolphin, a cat, a rabbit, a penguin and a dog.

In another aspect, there is provided a connecting assembly, wherein the connector body is modeled as a mechanical object, and wherein the connector body is further configured with at least one, two, three or four slots for accepting a plurality of protrusions. In one embodiment of the above, the connector body is further selected from a group consisting of flying and moving objects. In another embodiment, the connector body is configured to be selected from a group consisting of an aircraft, a sea vessel and a wheeled craft. In one embodiment, the connector body is configured to be selected from a group consisting of a jet, a helicopter, a ship, a bike, a motorbike, a car and a train.

In another aspect, there is provided a connecting assembly, wherein the connector body is configured to be adopted to be able to incorporate a symbol or display that may be selected from a group consisting of a logo, a mascot and a mark of an organization; and/or wherein the connector body is further configured with at least one, two, three or four slots for reversibly accepting a plurality of protrusions. In one embodiment of the above, the connector body is a symbol of a fraternity, a sorority or a school. In yet another embodiment, the connector body may be configured to display a logo of a company, such as Apple®, Facebook®, IBM®, GE®, Pfizer® or Coca-Cola®. In one embodiment, the logo or symbol is used for the advertisement or promotional purpose of the organization. In one embodiment, the connector body is a sacred symbol such as a religious figure, theme or symbol.

In another aspect, there is provided a connecting assembly, wherein the connector body is configured to further adopt or accept a mechanical or an electronic device, such as a security or communication device (e.g., a mini walkie talkie, mini cell phone), a wireless application device, an LED light, a tracking device (e.g., a GPS unit), a time piece and a light source, and wherein the connector body is further configured with at least one, two, three or four slots for accepting a plurality of protrusions. In one particular embodiment of the above, the connector body comprises a watch face.

In one aspect, there is provided a connecting assembly, wherein the connector body is modeled as a vegetable or a fruit (e.g., an apple, orange, cherry, strawberry etc . . . ), and wherein the connector body is further configured with at least one, two, three or four slots for accepting a plurality of protrusions. In one embodiment of the above, the connector body is configured to be able to adopt a form selected from a group consisting of a banana, an apple, a carrot and a tomato.

In one aspect, there is provided a connecting assembly, wherein the connector body is modeled as an astronomical object, and wherein the connector body is further configured with at least one, two, three or four slots for reversibly accepting a plurality of protrusions. In one embodiment of the above, the connector body is selected from a group consisting of a star, a planet, a comet, a star system and a galaxy.

In one variation of the above, there is provided a connecting assembly, wherein the connector body is configured to be able to adopt a form selected from a seashell, a skull and cross-bone, and wherein the connector body is further configured with at least one, two, three or four slots or more, for accepting a plurality of protrusions.

In one variation of the above, there is provided a connecting assembly, wherein the connector body is modeled as human organs or body parts, and wherein the connector body is further configured with at least one, two, three or four slots for accepting a plurality of protrusions. In one embodiment of the above, the connector body is selected from a group consisting of a heart, a hand and an arm.

In one variation of the above, there is provided a connecting assembly, wherein the connector body is configured to accept printing, embossing and patterning, and wherein the connector body is further configured with at least one, two, three or four slots for accepting a plurality of protrusions.

In one aspect, there is provided a connecting assembly, wherein the protrusion is substantially conical, spherical, rectangular, triangular, annular and oval, wherein the protrusion comprising a circumference or diameter substantially the same as or different from the circumference or diameter of the linker, and wherein the protrusion is substantially hollow or solid. In one aspect, the protrusion may be reversibly and compressibly deformed, wherein the protrusion resumes its original shape after being urged through a slot.

In another aspect, there is provided a connecting assembly, wherein the slot comprises a circumference or diameter that is smaller than the circumference or diameter of the protrusion; wherein at least one protrusion is readily urged through at least one slot to form a connection between a plurality of linkers and a plurality of connector bodies; and wherein the protrusion is not readily dislodged from the slot without the application of force that deforms the protrusion or the slot, or both. In one embodiment of the above, the slot is a through slot or an aperture. The slot/aperture may also be expandable, wherein the slot may be stretched to allow more than one protrusions to be urged through, after which the slot resume its original shape.

In one particular aspect, there is provided a linker comprising a proximal end and a distal end, the distal end comprising a protrusion, the proximal end comprising a slot, wherein the slot is configured to accept the protrusion. In one aspect, there is provided a linker, wherein the protrusion comprises a circumference or diameter that is at least equal to the circumference or diameter of the linker, and wherein the slot comprises a circumference or diameter that is smaller than the circumference or diameter of the protrusion and of the linker. In one embodiment, the protrusion comprises a circumference or diameter that is smaller or larger than the circumference or diameter of the linker, and wherein the slot comprises a circumference or diameter that is smaller or bigger than the circumference or diameter of the linker. In various embodiments, the slot comprises a circumference or diameter that is smaller than the circumference or diameter of the protrusion. In one embodiment of the above, the linker is silicone or silicone composite.

In one aspect of the invention, there is provided a wearable band comprising at least one connecting assembly, one linker, and a connecting band. In one embodiment of the above, the connecting band further comprising at least one connecting assembly, at least one linker, and a plurality of interconnected rings, wherein the ring is silicone or silicon composite or an elastomer.

In one aspect, there is provided a method of reversibly connecting at least one linker and at least one connector body of the connecting assembly comprising urging the protrusion through the slot on the connector body or through the slot on the linker, wherein the protrusion is not readily dislodged from the slot without the application of force that deforms the protrusion or the slot.

In one aspect, there is provided a method of reversibly connecting a plurality of linkers comprising urging the protrusion on the distal end through the slot on the proximal end, wherein the protrusion and the slot are on the same or different linker, and wherein the protrusion is not readily dislodged from the slot without the application of force that deforms the protrusion or the slot.

In one aspect, there is provided a linker comprising a linker body having a first end and a second end, wherein the first end is configured with a first slot, wherein the second end is configured with a second slot, wherein the first slot is configured to form a reversible connection with the second slot or a third slot or a protrusion and wherein the linker, the linker body and the slot comprise of material selected from silicone or a silicone composite. In one embodiment, the first slot is configured to form a reversible connection with the second slot or a protrusion on the same linker body. In another embodiment, the first slot is configured to form a reversible connection with a third slot on a second linker body. In all embodiments of the above, the slots are expandable slots.

In one aspect, there is provided a plurality of linkers wherein said linkers comprise a branched configuration, or a multi-branched configuration. A multi-branched configuration may comprise at least 2, 3, 4, 5 6, 7, 8, 9, 10, 11 branches, as defined herein.

In another aspect, there is provided a plurality of linkers wherein said linkers comprise a forked configuration. In one embodiment, a forked configuration may comprise at least 2, 3, 4, 5, 6, 7, 8, 9, 10, 11 forks, as defined herein.

In yet another aspect, there is provided a plurality of linkers wherein said linkers comprises a networked configuration.

In one aspect, there is provided a linker, wherein the linker further comprises a plurality of protrusions.

In another aspect, there is provided a linker, wherein the linker further comprises a structure.

In yet another aspect, there is provided a linker assembly comprising at least one linker, wherein the linker comprises at least one linker body having a first end and a second end, wherein the first end is configured with a first slot and the second end is configured with a second slot, wherein the linker body is joined length-wise along the length of a first edge of a sheet comprising the first edge and a second edge, wherein another linker body is joined length-wise along the length of the second edge and of the sheet, wherein the linker and the sheet comprise of material selected from silicone or a silicone composite.

In one aspect, the sheet is a pliable sheet.

In yet another aspect, the sheet is configured to accept printing, embossing and patterning.

In another aspect, there is provided a linker assembly, comprising at least one linker, a sheet, and at least one slot, wherein the linker assembly further comprises at least one protrusion.

In yet another aspect, the linker assembly further comprises a structure.

In one aspect, there is provided a method of connecting one or more slots configured on a plurality of linkers to form a reversible connection comprising urging the first slot through the second slot configured on the same or different linker, wherein either slot forms a reversible connection and is not dislodged from the other slot under normal wearing condition.

In another aspect, the method further comprises urging one or more protrusions through one or more slots, wherein the protrusion and the slot are on the same or different linkers, and wherein the protrusion is not dislodged from the slot under normal wearing condition.

BRIEF DESCRIPTION OF THE DRAWINGS

These and other features, aspects, and advantages of the present invention will become apparent from the following description, appended claims, and the accompanying exemplary embodiments shown in the drawings, which are briefly described below.

DETAILED DESCRIPTION OF THE PREFERRED EMBODIMENTS

Figure 1:
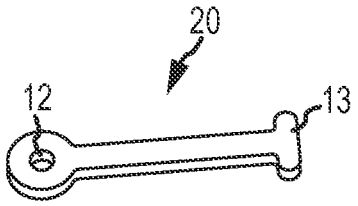
FIG. 1 is a top view of a linker according to one exemplary embodiment.

The invention is described in more detail hereinafter with reference to exemplary embodiments. In the figures, the same reference numerals are used for similar components in different embodiments. It is understood that the invention is not limited in its application to the details of construction and the arrangement of components set forth in the following description or illustrated in the following drawings. The invention is capable of other embodiments and of being practiced or of being carried out in various ways. Also, it is understood that the phraseology and terminology used herein is for the purpose of description and should not be regarded as limiting.

Referring to FIG. 1, a linker 20 is shown according to an exemplary embodiment. The linker 20 comprises a slot 12 and a protrusion 13.

Figure 2:
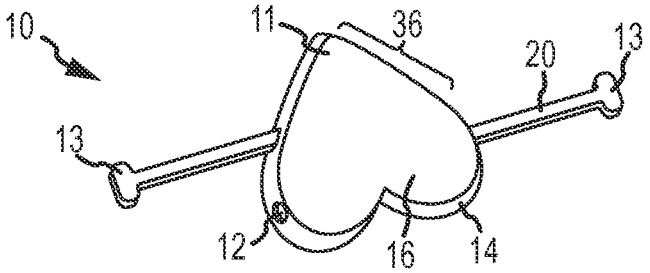
FIG. 2 is a top view according to one exemplary embodiment of a connecting assembly showing a connector body modeled as a heart with a skirt, a slot configured on the connector body and two linkers attached at the proximal end to the connector body, with a protrusion on the distal end of each linker.

Referring to FIG. 2, a connecting assembly 10 is shown according to an exemplary embodiment. The connecting assembly 10 comprises a connector body 11 with a top face 16 modeled as a heart 36 and a linker 20. In one embodiment, the connector body 11 comprises a skirt 14. A slot 12 is configured on the skirt 14 of the connector body 11. In one embodiment, the linker 20 comprises a protrusion 13 and is connected to the connector body 11 at the proximal end. The slot 12 is configured to accept the protrusion 13.

Figure 3:
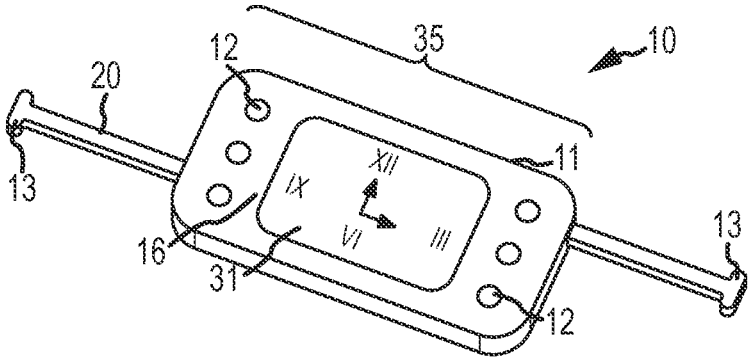
FIG. 3 is a top view according to one exemplary embodiment of a connecting assembly showing a connector body modeled as a flat rectangular comprising a watch face, with multiple slots configured on the connector body and two linkers attached at the proximal end to the connector body, with a protrusion on the distal end of each linker.

Referring to FIG. 3, a connecting assembly 10 is shown according to an exemplary embodiment. The connecting assembly 10 comprises a connector body 11 with a top face 16 and a linker 20. In one embodiment, the connector body 11 is a flat rectangle 35. In one embodiment, the linker 20 comprises a protrusion 13 and is connected to the connector body 11 at the proximal end. In one embodiment, a slot 12 is configured on the connector body 11 which also comprises a watch face 31.

Figure 4:
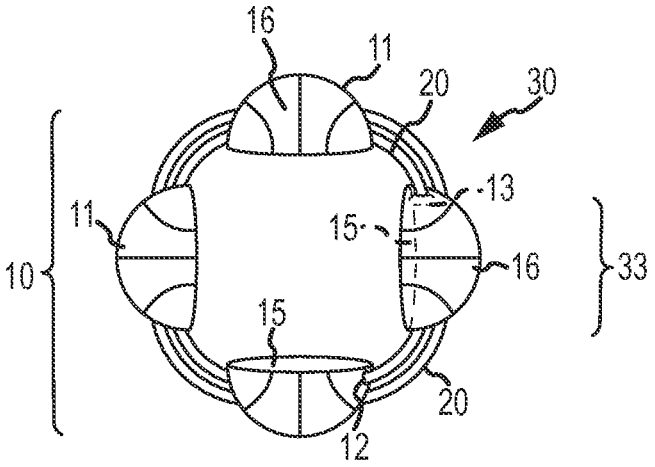
FIG. 4 is a side view according to one exemplary embodiment of a wearable band comprising multiple connecting assemblies, showing the connector body modeled as a half-basketball.

Referring to FIG. 4, a wearable band 30 is shown according to an exemplary embodiment that comprises a plurality of the connecting assembly 10. In one embodiment, the connecting assembly 10 further comprises a connector body 11 modeled as a half-basketball 33 with a slot 12 configured on the connector body 11 and a linker 20. In one embodiment, the connector body 11 has a bottom face 15 and a top face 16. The linker 20 comprises a protrusion 13 which is urged through the slot 12. The protrusion 13 is illustrated in broken line to represent that the protrusion 13 is hidden from view.

Figure 5:
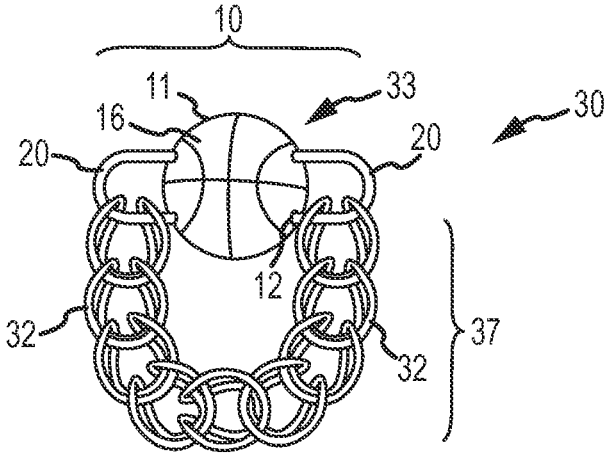
FIG. 5 is a top view of a wearable band showing a connecting assembly according to one exemplary embodiment.
Figure 8:
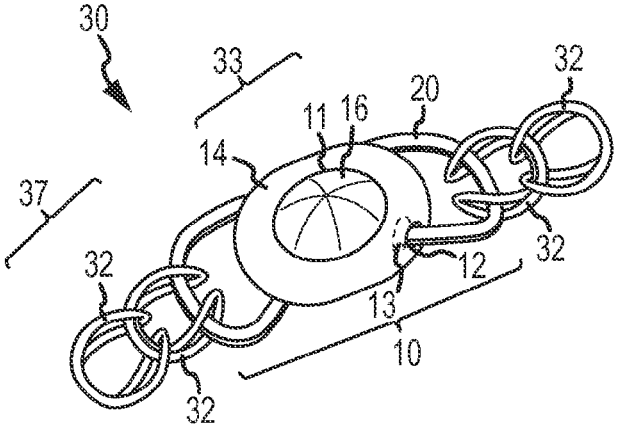
FIG. 8 is a top view of a connecting assembly connected to elastic rings according to an exemplary embodiment.

Referring to FIGS. 5 and 8, a wearable band 30 is shown according to an exemplary embodiment that comprises a connecting assembly 10 and a connecting band 37 which comprises a plurality of rings 32. In one embodiment, the connecting assembly 10 comprises a connector body 11 with a top face 16, a linker 20 and a skirt 14. In one embodiment, the connector body 11 is modeled as a half-basketball 33. In another embodiment, a slot 12 is configured on the connector body 11. In one embodiment, the slot 12 is configured on the skirt 14. The linker 20 comprises a protrusion 13, represented by broken line to represent that the protrusion 13 is hidden from view.

Figure 6:
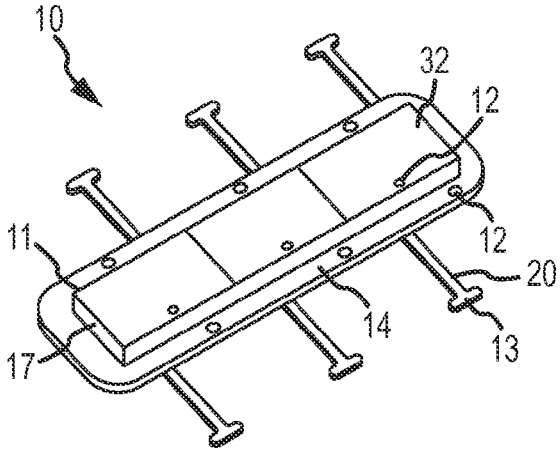
FIG. 6 is a top view of a connecting assembly according to an exemplary embodiment.
Figure 7:
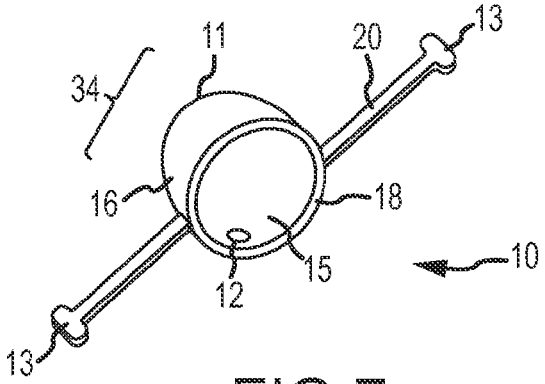
FIG. 7 is a bottom side view of a connecting assembly according to an exemplary embodiment.

Referring to FIGS. 6 and 7, a connecting assembly 10 according to one exemplary embodiment is shown that comprises a connector body 11 with a bottom face 15 and a top face 16, and a linker 20. In one embodiment, the connector body 11 comprises a skirt 14. In another embodiment, the connector body 11 comprises a lip 18. In another embodiment, a slot 12 or a plurality of slots 12 is configured on the connector body 11 or the skirt 14. In various embodiments, the connector body 11 can be a pill box 32, a semi-sphere 34. In one embodiment, the linker 20 comprises a protrusion 13.

Figure 12:
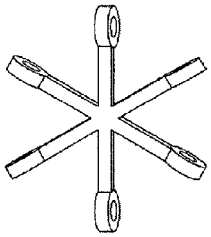
FIG. 12 is a top view of a plurality of linkers in a networked configuration according to an exemplary embodiment.

Referring to FIG. 12, a plurality of linkers 20 in a networked configuration is shown according to an exemplary embodiment. The configuration comprises linkers 20 and slots 12.

Figure 13:
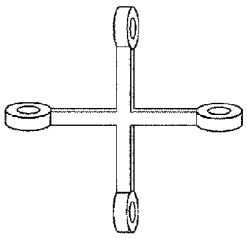
FIG. 13 is a top view of a plurality of linkers in a cross configuration according to an exemplary embodiment.

Referring to FIG. 13, a plurality of linkers 20 comprises a cross configuration is shown according to an exemplary embodiment. The cross configuration comprises slots 12 attached to linkers 20.

Figure 14:
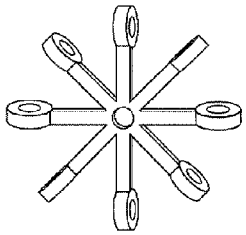
FIG. 14 is a top view of a plurality of linkers in a networked configuration according to an exemplary embodiment.

Referring to FIG. 14, a plurality of linkers 20 comprises a networked configuration is shown according to an exemplary embodiment. The network comprises linkers 20 and slots 12. In one embodiment, the slot 12 is configured in the center of the network.

Figure 15:
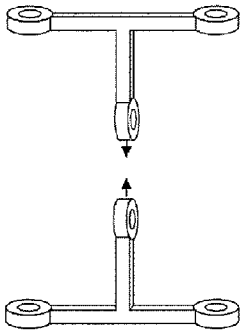
FIG. 15 is top view of a plurality of linkers in a forked configuration according to an exemplary embodiment.
Figure 9:
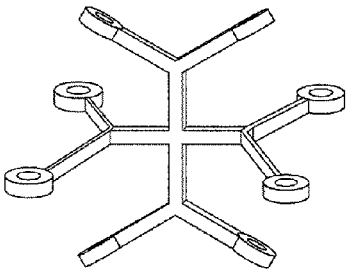
FIG. 9 is a side view of a plurality of linkers in a branched configuration according to an exemplary embodiment.
Figure 10:
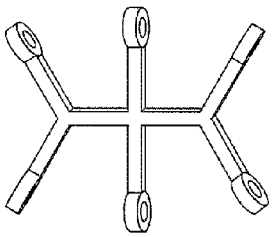
FIG. 10 is a side view of a plurality of linkers in a branched configuration according to an exemplary embodiment.
Figure 11:
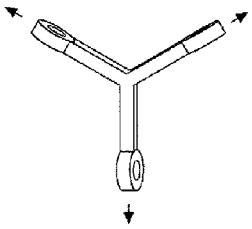
FIG. 11 is a side view of a plurality of linkers in a forked configuration according to an exemplary embodiment.
Figure 16:
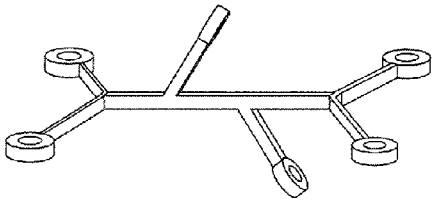
FIG. 16 is side view of a plurality of linkers in a branched configuration according to an exemplary embodiment.
Figure 17:
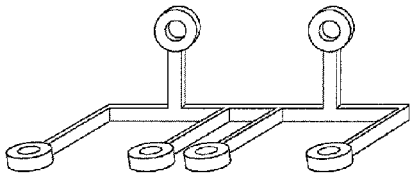
FIG. 17 is a side view of a plurality of linkers in a branched configuration according to an exemplary embodiment.
Figure 18:
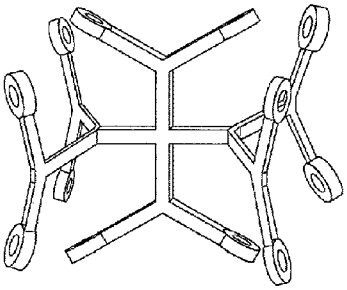
FIG. 18 is a side view of a plurality of linkers in a branched configuration according to an exemplary embodiment.

Referring to FIGS. 11 and 15, a plurality of linkers 20 comprises forked configurations are shown according to exemplary embodiments. In one embodiment, the forked configuration is a centered-3-forked, comprising linkers 20 and slots 12. In another embodiment, the forked configuration is a center-lined forked configuration.

Referring to FIGS. 9, 10, 16, 17 and 18, a plurality of linkers 20 comprises branched configurations are shown according to exemplary embodiments. In one embodiment, the linkers 20 and the slots 12 are contained in the same plane. In another embodiment, the linkers 20 and the slots 12 are defined by different planes. In yet another embodiment, the branched linkers 20 themselves are further branched. In one embodiment, a first linker 20 comprises a linker body with a first and a second end, wherein the first end of the first linker 20 is configured to attached to a first end of a second linker 20, and wherein the second end of the first linker 20 may be configured to attach to a first end of a third linker 20. In another embodiment, a plurality of slots 12 may be configured to attach the ends of the linker body, wherein said ends are not attached to other ends of different linkers 20. In another embodiment, one end of a first linker 20 may be configured to attach to the linker body of a second linker 20.

Figure 19:
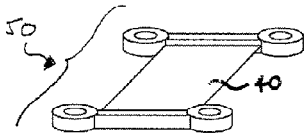
FIG. 19 is a top view of a linker assembly comprising two linkers and a sheet according to an exemplary embodiment.

Referring to FIG. 19, a linker assembly comprises linkers 20, slots 12 and a sheet 40 is shown according to an exemplary embodiment.

Figure 20:
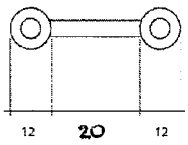
FIG. 20 is a top view of a linker comprising two slots according to an exemplary embodiment.

Referring to FIG. 20, a linker 20 comprising a linker body having a first end and a second end, wherein a first slot 12 is configured on the first end and a second slot 12 is configured to the second end of the linker body of the linker 20 is shown according to an exemplary embodiment.

In one aspect of the invention, there is provided a connecting assembly 10 for connecting a wearable band 30 comprising at least one connector body 11, the connector body 11 comprising a top face 16, a bottom face 15 and a side 17; at least one linker 20, the linker 20 comprising a proximal end and a distal end, the distal end comprising a protrusion 13; at least one slot 12, wherein the slot 12 is configured on the connector body 11 or configured on the linker 20; wherein the proximal end of the linker 20 is connected to the connector body 11; wherein the slot 12 on the connector body 11 or on the linker 20 is configured to accept the protrusion 13 to connect the distal end of the linker 20 to the connector body 11 or to the slot 12 on the linker 20; and wherein the linker 20 and the connector body 11 comprise silicone or a silicone composite.

In various embodiments, the slot 12 and protrusion 13 can optionally be on axially opposite ends thereof. In one embodiment, the slot 12 is configured as an eye similar to an eye of a needle. In one aspect of the invention, the connecting assembly 10 comprises a composite of deformable or flexible elastomers. In another embodiment, the connecting assembly 10 comprises rubber. In one embodiment, the connecting assembly 10 is constructed from plastic or other elastic materials. In one embodiment, the connecting assembly 10 is constructed from leather. In another embodiment, the connector body 11 further comprises precious metals, gems stone, diamond or rare earth metals. In one embodiment, the connecting assembly 10 comprising a linker 20 and a connector body 11, wherein the connecting assembly 10 is a unitary construction of silicone or silicone composite constructed from a single mold and a single mold extrusion process.

In one aspect, there is provided a connecting assembly 10, wherein the connector body 11 comprises of at least one, two, three, or four slots 12 for accepting a plurality of protrusions 13. In one embodiment of the above, the connector body 11 further comprises at least five, six, or seven slots 12. In another aspect, there is provided a connecting assembly 10, wherein the connector body 11 is substantially hollow or solid.

In another aspect, there is provided a connecting assembly 10, wherein the connector body 11 is substantially spherical or semi-spherical, substantially rectangular or semi-rectangular, or substantially oval or semi-oval. In various embodiments of the above, the connector body 11 is conical, triangular, rhomboid or diamond shaped. In another embodiment, the connector body 11 is elongate or annular. In one embodiment, the connector body 11 is a dome or a half-dome 34. In another embodiment, the connector body 11 is a rectangle 35. In another embodiment, the connector body 11 further comprises a skirt 14 that is attached to the connector body 11 and radially projects from the connector body 11. In various embodiments of the above, the connector body 11 may be hollow or solid.

In one aspect, there is provided a connecting assembly 10, wherein the connector body 11 is substantially flat. In another aspect, there is provided a connecting assembly 10, wherein the connector body 11 is configured to accept a decal or an image. In one embodiment of the above, the connector body 11 may be configured to accept printing comprising words or phrases or slogans. In another embodiment, the connector body 11 may be configured to accept patterns, or etching, engraving, debossing or embossing.

In another aspect, there is provided a connecting assembly 10, wherein the top face 16 is convex and the bottom face 15 is concave. In one embodiment of the above, the top face 16 may be concave and the bottom face may be convex. In another embodiment, the top face 16 and the bottom face 15 both may be substantially flat. In one particular embodiment, the top face 16 is concave and the bottom face 15 is convex, wherein the top face 16 further comprises a lip 18 that is directed centripetally.

In one aspect, there is provided a connecting assembly 10, wherein the connector body 11 is modeled as a sport accessory or equipment. In one embodiment of the above, the connector body 11 is selected from a group consisting of a basketball, a semi-basketball 33, a baseball bat, a tennis racquet and swimming goggles. In another embodiment, the connector body 11 is a base ball, a golf ball, a soccer ball, a football, a volley ball, a tennis ball or any semi-ball thereof. In yet another embodiment, the connector body 11 is selected from a group consisting of sport racquet such as a ping pong racquet, a squash racquet and a badminton racquet. In one embodiment, the connector body 11 is selected from a group consisting of baseball, football, and basketball equipment or accessory such as a baseball cap, a football helmet, a basketball backboard and a baseball plate. In another embodiment, the connector body 11 is selected from a group consisting of hockey equipment such as a puck and a hockey stick. In one embodiment, the connector body 11 is selected from a group consisting of a skateboard, a discus, a ski goggles and a snowboard. In another embodiment, the connector body 11 is selected from a group consisting of gymnastic equipment such as a gymnastic ring, a vaulting horse and a pommel horse. In other embodiment, the connector body 11 is selected from a group consisting of aquatic and water sport equipment such as diving and swimming gears. In one embodiment, the connector body 11 is selected from a group consisting of a snorkel, a fin, a floatation device, rowing, kayaking and river rafting equipment. In one embodiment, the connector body 11 is selected from a group consisting of sailboat, a sailboard and a kite board.

In another aspect, there is provided a connecting assembly 10, wherein the connector body 11 is modeled as an animal or an insect. In one embodiment of the above, the connector body 11 is selected from a group consisting of a bird, a ladybug, a butterfly, a horse, a sea lion, a dolphin, a cat, a rabbit, a penguin and a dog. In one embodiment, the connector body 11 is selected from a group consisting of aquatic or land animal and insect. In another embodiment, the connector body 11 is selected from a group consisting of insect such as a caterpillar, a honeybee, a millipede, a dragon fly, a crustacean, a fish and an echinoderm such as a starfish. In another embodiment, the connector body 11 is selected from a group consisting of domesticated animals such as pig and cow. In another embodiment, the connector body 11 is selected from a group consisting of wild animals such as a deer, a boar, a bear, a lion, a giraffe, a zebra and a hippo. In another embodiment, the connector body 11 is selected from a group consisting of flight bird such as a falcon, a hawk, an eagle, a parrot, a crane, owl, a hummingbird, a dove and a flamingo. In another aspect, there is provided a connecting assembly 10, wherein the connector body 11 is modeled as a mechanical object. In one embodiment of the above, the connector body 11 is further selected from a group consisting of flying and moving object. In another embodiment, the connector body 11 is selected from a group consisting of an aircraft, a sea vessel and a wheeled craft. In one embodiment, the connector body 11 is selected from a group consisting of a jet, a helicopter, a ship, a bike, a motorbike, a car and a train. In one embodiment, the connector body 11 is selected from a group consisting of a hot air balloon, a kite, a glider, a rocket or spacecraft and a parachute.

In another aspect, there is provided a connecting assembly 10, wherein the connector body 11 is selected from a group consisting of a logo, a mascot and a mark of an organization. In one embodiment of the above, the connector body 11 is a symbol of a fraternity, a sorority, or a school. In another embodiment, the connector body 11 is a mascot of a sport team or a school team. In yet another embodiment, the connector body 11 is a logo of a company such as Apple®, Facebook®, IBM®, GE®, Pfizer® or Coca-Cola®. In one embodiment, the connector body 11 is a sacred symbol such as a religious figure, theme, or symbol. In another aspect, there is provided a connecting assembly 10, wherein the connector body 11 further comprising a safety feature, a time piece and a light source. In one particular embodiment of the above, the connector body 11 comprises a watch face 31. In another embodiment, the connector body 11 comprises a GPS tracking device, a communication device or LED lights. In one embodiment, the connector body 11 comprises an electronic device selected from a group consisting of a panic alarm, a tracking device, a mini walkie talkie, a reflective material and a light source such as a flashing light. In another embodiment, the connector body 11 comprises a counter. In various aspects, the connector body 11 further comprises other suitable electronic devices for daily usage, such as wireless application devices.

In one aspect, there is provided a connecting assembly 10, wherein the connector body 11 is modeled as a vegetable or a fruit. In one embodiment of the above, the connector body 11 is selected from a group consisting of a banana, an apple, a carrot and a tomato. In one aspect, there is provided a connecting assembly 10, wherein the connector body 11 is modeled as an astronomical object. In one embodiment of the above, the connector body 11 is selected from a group consisting of a star, a planet, a comet, a star system and a galaxy. In one aspect, there is provided a connecting assembly 10, wherein the connector body 11 is modeled as a seashell, a skull and cross-bone.

In one aspect, there is provided a connecting assembly 10, wherein the connector body 11 is modeled as human organs or body parts. In one embodiment of the above, the connector body 11 is selected from a group consisting of a heart 36, a hand and an arm. In one embodiment, the connector body 11 is selected from a group consisting of cross-linking arms, shaking hands and two or more hearts attached to one another, wherein the hearts 36 are partly superimposed on each other. In various aspects, the connector body 11 serves the wearer's daily needs including medical, safekeeping or storage. In one embodiment, the connector body 11 is selected from a group consisting of a pill box 32, an eraser box and a memory box for storing keepsakes.

In one aspect, there is provided a connecting assembly 10, wherein the connector body 11 is configured to accept printing, embossing, debossing and patterning. In one aspect, there is provided a connecting assembly 10, wherein the protrusion 13 is substantially conical, spherical, rectangular, triangular, annular and oval, wherein the protrusion 13 comprising a circumference or diameter at least equal to the circumference or diameter of the linker 20, and wherein the protrusion 13 is substantially hollow or solid.

In another aspect, there is provided a connecting assembly 10, wherein the slot 12 comprises a circumference or diameter that is smaller than the circumference or diameter of the protrusion 13 and of the linker 20; wherein at least one protrusion 13 is urged through at least one slot 12 to form a connection between a plurality of linkers 20 and a plurality of connector bodies 11; and wherein the protrusion 13 is not readily dislodged from the slot 12 under normal wearing condition. In one embodiment of the above, the slot 12 is a through slot.

In one particular aspect, there is provided a linker 20 comprising a proximal end and a distal end, the distal end comprising a protrusion 13, the proximal end comprising a slot 12, wherein the slot 12 is configured to accept the protrusion 13. In one aspect, there is provided a linker 20, wherein the protrusion 13 comprises a circumference or diameter that is at least equal to the circumference or diameter of the linker 20, and wherein the slot 12 comprises a circumference or diameter that is smaller than the circumference or diameter of the protrusion 13 and of the linker 20. In one embodiment of the above, the linker 20 comprises of material selected from silicone or silicone composite.

In one aspect of the invention, there is provided a wearable band 30 comprising at least one connecting assembly 10, one linker 20, and a connecting band 37. In one embodiment of the above, the connecting band 37 further comprises at least one connecting assembly 10 and at least one linker 20.

In one aspect, there is provided a method of connecting at least one linker 20 and at least one connector body 11 of the connecting assembly 10 to form a reversible connection to form a wearable band 30 comprising urging the protrusion 13 through the slot 12 on the connector body 11 or through the slot 12 on the linker 20, wherein the protrusion 13 is not dislodged from the slot 12 under normal wearing conditions.

In one aspect, there is provided a method of connecting a plurality of linkers 20 to form a reversible connection to form a wearable band 30 comprising urging the protrusion 13 on the distal end through the slot 12 on the proximal end, wherein the protrusion 13 and the slot 12 are on the same or different linker 20, and wherein the protrusion 13 is not dislodged from the slot 12 under normal wearing condition. In one variation of each of the above embodiments, the connector body 11 further comprises at least five, six, seven or more slots.

In one aspect of the present application, there is provided a linker 20 comprising a linker body having a first end and a second end, wherein the first end is configured with a first slot 12, wherein the second end is configured with a second slot 12, wherein the first slot 12 is configured to form a reversible connection with the second slot 12 or a third slot 12 or a protrusion 13 and wherein the linker 20, the linker body and the slot 12 comprise of material selected from silicone or a silicone composite.

In another aspect, one or more slots 12 are configured on the linker 20, wherein the slot 12 is configured on the linker body between the first end and the second end of the linker body. In one embodiment, one or more slots 12 may be configured on the linker 20, wherein the slot 12 is configured and attached on the linker body between the first and the second end, and wherein the slot 12, being defined by a plane, may be configured wherein the plane of the slot 12 extends in different directions about the linker body.

In yet another aspect, one or more slots 12 are configured on the first and second end, wherein the slot(s) 12 or ring(s) may project out and about a longitudinal axis through the center of and along the length of the linker body. In one embodiment, one or more slots 12 are configured on the first end and one or more slots 12 are configured on the second end of the linker 20, wherein the two slots 12, that may be defined by two different planes, may be substantially perpendicular to each other. In various embodiments of the above, one or more slots 12 may be configured on both ends of the linker 20, wherein the planes defining the slots 12 may intersect from about 0° to 90° to each other.

In one aspect of the above, there is provided a linker 20, wherein a plurality of said linkers 20 comprise a branched configuration. In one embodiment, the branched configuration is a 3-branched configuration.

In another aspect of the present application, the linker 20 comprises a branched configuration, wherein the branch may radiate outwardly from a common center or common location, or a different location on the linker body. In one embodiment of the above, the common center optionally comprises one or more slots 12.

In another aspect, the linkers 20 comprising a branched configuration may have the same or different length.

In another aspect, the linker 20 is a multi-branched configuration, wherein a plurality of the branches themselves comprise branched configuration. In one embodiment of the above, the branches may be contained in the same 2D geometrical plane. In another embodiment, the branches may be contained in different 3D geometrical planes or space or may extend in different directions from each other.

In one aspect, a plurality of slots 12 is configured on the ends of the branched configuration. In various embodiments, the slots 12 may be attached at the ends or on the body of the linkers 20 of a branched configuration, wherein the slots 12 or the planes defining the slots 12 are configured to be from about 0° to 90° to each other.

In another aspect of the present application, there is provided a linker 20, wherein a plurality of said linkers 20 comprises a forked configuration. In one embodiment, the configuration is a 2-forked configuration. In another embodiment, the linker 20 comprises a 3-forked configuration. In yet another embodiment, the linker 20 may be a centered-3-forked configuration. In various embodiments, the linker 20 may be a center-forked or a multi-forked configuration. In one embodiment, all of the linker 20's forks may be configured to be perpendicular to each other or may be defined by different planes wherein the planes intersect at about 90°. In one embodiment, the forks may be defined by the same 2D geometrical plane or by different 3D geometrical space.

In yet another aspect, one or more slots 12 may be optionally configured in the center of a centered-forked configuration.

In one aspect of the present application, there is provided a linker 20 wherein a plurality of said linkers 20 comprises a networked configuration. In one embodiment, the network is a center-lined network. In another embodiment, a plurality of linkers 20 comprises a bi-directional networked configuration. In one embodiment, the network may be a multi-directional networked configuration. In another embodiment, the network may be a fully-connected network. In yet another embodiment, the network may be a ring network.

In another aspect of the present application, a plurality of linkers 20 comprises a cross configuration, wherein the cross configuration optionally further comprises branched or forked or networked configurations.

In yet another aspect of the present application, there is provided a linker 20, further comprising a plurality of protrusions 13. In one embodiment, one or more protrusions 13 are configured on the linker body, wherein the protrusion 13 is attached to the linker body in between the first end and the second end of the linker 20, and wherein the protrusion 13 is configured to extend in different directions.

In one aspect of the present application, a linker 20 comprises a linker body having a first and a second end, wherein one or more protrusions 13 are configured on the first end and the second end of the linker body, wherein the protrusion 13, being defined by a plane, may be configured wherein the plane of the protrusion 13 extends in different directions about the linker body of the linker 20.

In another aspect of the present application, one or more protrusions 13 are configured on the first and second end, wherein the protrusion(s) 13 may project out and about a longitudinal axis through the center of and along the length of the linker body of the linker 20. In one embodiment, one or more protrusions 13 are configured on the first end and one or more protrusions 13 are configured on the second end of the linker body of the linker 20, wherein the two protrusions 13, that may be defined by two different planes, may be substantially perpendicular to each other. In various embodiments of the above, one or more protrusions 13 may be configured on both ends of the linker body of the linker 20, wherein the planes defining the protrusions 13 may intersect from about 0° to about 90° to each other.

In yet another aspect of the present application, one or more protrusions 13 are configured on a branched or forked or networked configuration. In one embodiment, the protrusion(s) 13 is attached at the ends of a branched or forked or networked configuration. In another embodiment, one or more slots 12 and one or more protrusions 13 may be attached to the ends of a linker body of the linker 20. In yet another embodiment, one or more slots 12 and one or more protrusions 13 are attached on and extend about a linker body of the linker 20.

In one aspect of any one of the above, there is provided a linker 20, further comprising a structure. In one embodiment, the structure may be a geometric solid or hollow structure. In another embodiment, the sides of the geometric structure may have identical or different dimension. In one embodiment, the structure may be a cylinder. In another embodiment, the structure may be cube or a sphere. In various embodiments of the above, the structure may be of silicon, silicon composite or elastomeric material. In another embodiment, the structure comprises semi-rigid or rigid material or composite. In yet another embodiment, the structure may be hollow or solid. In one embodiment, the structure may be a lattice.

In another aspect of the present application, there is provided a linker assembly comprising at least one linker 20, wherein the linker 20 comprises at least one linker body having a first end and a second end, wherein the first end is configured with a first slot 12 and the second end is configured with a second slot 12, wherein the linker body is joined length-wise along the length of a first edge of a sheet 40 comprising the first edge and a second edge, wherein another linker body is joined length-wise along the length of the second edge and of the sheet 40, wherein the linker 20, the slots 12 and the sheet 40 comprise of material selected from silicone or a silicone composite.

In one aspect of the present application, there is provided a linker assembly, wherein the linker body of the linker 20 and the sheet 40 are joined length-wise along the length of the linker body and the edge of the sheet 40.

In another aspect of the present application, there is provided a linker assembly, wherein the sheet 40 is configured to accept printing, embossing and patterning. In one embodiment, the sheet 40 comprises writings such as slogans. In another embodiment, the sheet 40 comprises images such as logos or marks of organizations.

In one aspect of the present application, the sheet 40 is a pliable sheet. In another aspect, the sheet 40 is a non-pliable sheet. In one embodiment, the sheet 40 may be selected from rigid or semi-rigid materials or composite.

In one aspect of the above, there is provided a linker assembly, further comprising at least one protrusion 13. In one embodiment, one or more slots 12 and, optionally, one or more protrusions 13 may be attached to the ends or the body of a linker 20.

In yet another aspect of the present application, the slot(s) 12, the protrusion(s) 13, the linker(s) 20 and the sheet 40 may be contained in the same or different planes. In one embodiment, the planes may intersect at about 90° or at an angle different than 90° to each other.

In one aspect of the present application, there is provided a linker assembly, further comprising a structure. In one embodiment, the structure may be a geometric solid or hollow structure. In another embodiment, the sides of the geometric structure may have identical or different dimension. In one embodiment, the structure may be a cylinder. In another embodiment, the structure may be cube or a sphere. In various embodiments of the above, the structure may be of silicon, silicon composite or elastomeric material. In another embodiment, the structure comprises semi-rigid or rigid material or composite. In yet another embodiment, the structure may be hollow or solid. In one embodiment, the structure may be a lattice.

In one aspect of the present application, there is provided a method of connecting one or more slots 12 configured on a plurality of linkers 20 to form a reversible connection comprising urging the first slot 12 through the second slot 12, wherein the slots 12 may be configured on the same or different linker 20, the same or different linker assembly, wherein the slots 12 form a reversible connection and one slot 12 is not dislodged from the other slot 12 under normal wearing condition.

In another aspect, there is provided the method above, further comprising urging one or more protrusions 13 through one or more slots 12, wherein the protrusion 13 and the slot 12 may be configured on the same or different linkers 20, the same or different linker assembly, wherein the protrusion 13 is not dislodged from the slot 12 under normal wearing condition.

DEFINITIONS

The term "astronomical object" as used herein refers to celestial bodies or objects that are structures that exist in the observable universe. Examples include the asteroids, moons, planets and the stars, and galaxies.

The term "bi-directional" as used herein refers to a network of a plurality of linkers wherein the linkers may be configured such that the network evolves, moves, or grows in two usually opposite directions.

The term "branched" as used herein refers to configuration of linkers wherein one linker may be configured on one end of another linker or in between the ends of another linker. This branched configuration may repeat one or more times. The branched configuration may be manufactured as a unitary construction by the mold extrusion process or from a plurality of linkers.

The term "center-lined" as used herein refers to a configuration of a plurality of linkers wherein each linker may be attached on a central linker that runs the entire length of the network.

The term "centered-3-forked" as used herein refers to a forked configuration where three linkers may radiate from a common point of origin and where the angles between the linkers may measure the same, for example 60°. The linkers in this configuration may be contained in the same or different geometrical planes.

The term "concave" as used herein refers to curving in or down or hollowed inward or downward.

The term "convex" as used herein refers to curving out or up or bulging outward or upward.

The term "centripetal" as used herein refers to direction or projection that is progressing inward toward the center or central axis of the connector body.

The term "connecting band" as used herein refers the closeable part of the wearable band that connects with the connecting assembly to form the wearable band.

The term "composite" as in "silicone composite" as used herein refers to engineered or naturally occurring materials comprising silicone and one or more constituent materials, with significantly different physical or chemical properties. Silicone composite may comprise fillers to improve properties or reduce cost. Silicone composite is generally strong and flexible, non-reactive, water-proof, stable and resistant to extreme conditions and temperatures.

The term "connecting assembly" as used herein refers to a flexible assembly that connects an optional closeable connecting band or bracelet to form a wearable band or bracelet. The wearable band or bracelet may be worn on a person or an animal's hand, finger, ear, head, arm, leg, neck and ankle or other body parts. Because such connecting assembly is substantially a removable band, the band may also be configured to attach to or on any objects, such as a bicycle or a part of a bicycle, car steering wheel, a cell phone, a PDA, a portable computer pad (e.g., an i-Pad) a water bottle, a post, a backpack or parts of a backpack, etc . . . . As disclosed herein, the connecting assembly comprises a connector body and a linker.

The term "connector body" as used herein refers to a structure of the connecting assembly that has various shapes including spherical, semi-spherical, dome or half-dome, flat disc, or rectangular, or any shape thereof further attached to a skirt or a lip. The connector body can be solid or hollow.

The term "craft" or "vessel" as used herein refer to a vehicle or watercraft or vessel that is used for transportation on the sea, in the air or in space.

The term "dislodging" or "dislodged" as used herein mean that the protrusion cannot be readily disconnected or decoupled from the slot after being urged through or accepted into the slot under normal wearing conditions.

The term "elastomer" as used herein refers to a polymer with elasticity.

The term "elastic" as used herein refers to the ability of a material such as silicon or rubber to be stretched and to revert to substantially the original form. Elastic deformation is a substantially reversible deformation of a material. Elastic deformation may also refer to the ability of a slot/aperture to be deformably expanded and of a protrusion to be compressibly deformed, wherein more than one compressed protrusion may be urged through one expanded slot.

The term "fully-connected" as used herein refers to a networked configuration wherein a plurality of linkers may be configured wherein each end of a linker is connected to another end of another linker. In one aspect, a fully-connected configuration may be a fully connected mesh. In another aspect, a fully-connected configuration may be permanently connected, such as a single molded structure. A fully-connected configuration may also be removably connected, wherein individual linkers are removably connected to other linkers.

The term "multi-forked" as used herein refers to a forked configuration where a plurality of linkers may radiate from a common point of origin. In one embodiment, the common point of origin may be one end of a linker. The plurality of linkers may be removably connected to the common point of origin. The common point of origin may also be located at any point along the length of the body of the linker. The common point of origin may be a slot or an aperture.

The term "geometrical plane" or "plane" as used herein refer to a flat, potentially flexible two-dimensional surface or a three-dimensional space. Two planes are either parallel or they intersect in a line. A line is either parallel to a plane, intersects it at a single point in three-dimensional space, or is contained in the plane. Two lines perpendicular to the same plane must be parallel to each other. Two planes perpendicular to the same line must be parallel to each other. In one aspect, a slot is defined by a plane when the slot is contained in the plane.

The term "lattice" as used herein refers to a regular geometrical arrangement of over an area or in space that resemble a lattice. In one aspect, the lattice may be cubic.

The term "lip" as used herein refers to the lip structure attached to the connector body and which projects centripetally toward the center of the connector body.

The term "linker" as used herein refers to one or more line-like element that comprises one or more slots, or one or more protrusions, and that connects one or a plurality of connector bodies or a plurality of similarly configured linkers together to form a band or a bracelet with fixed or adjustable size or length. In one aspect, a plurality of linkers is connected to form different configurations of linkers, wherein the linkers may have similar or different length. In another aspect, a plurality of linkers may be removably connected to form different configurations of linkers. For example, a linker assembly may comprise a plurality of removable linkers or removable linker assemblies, with each linker comprises one or more linker bodies; the slots then may be configured on the same or different linker body.

The term "longitudinal axis" as used herein refers to an axis that may extend in the direction of a length of a linker or an axis that may run lengthwise from the first end to the second end of the linker.

The term "mechanical object" as used herein refers to object that is a machine, operated by a machine, or derived from a machine.

The term "mold", "molding" or "molded" as used herein refers to a process of manufacturing by shaping pliable or elastic materials using a model such that the article of manufacture adopts an appearance substantially similar to the model.

The term "multi-directional" as used herein refers to a networked configuration of a plurality of linkers wherein the linkers are attached to the ends or the bodies of other linkers such that the network develops in different directions.

The term "network" as used herein refers to a configuration of a plurality of linkers. The linkers may be in an arrangement of intersecting horizontal, diagonal and vertical lines. The network configuration may be center-lined, ring, multi-directional, star or bus network. In one aspect, network and configuration may be interchangeable.

The term "organization" as used herein refers to an entity which can be public or private, non- or for-profit, religious or denominational. The organization may be a company, a religious body, a sport team, a school, a civic organization, or a common purpose association.

The term "perpendicular" as used herein refers to an angle of about 90° to a given line, plane, or surface.

The term "pliable" as used herein refers to material or shape or article that is easily bent or rolled or flexible. In one aspect, a pliable material may resume its original shape after being reversibly bent or deformed. In one aspect, the slot may be flexible such that the slot may be expandable or stretched to a size or diameter which is twice, three, four or more of the original diameter. In another aspect, the protrusion may be compressed to a size which is one half, one third, or one fourth or more of the original size. In one aspect, the linker body may be expanded to a size or length which is twice, three, four or more times of the original size or length. The linker, the slot and the protrusion may then resume the original shape and size.

The term "protrusion" as used herein refers to a protruded structure or a bulge on either a linker or a connector body that may be urged through or accepted into a slot to establish a reversible connection or reversible attachment between linkers and connector bodies or combinations thereof. Such protruded structure may encompass various symmetrical or unsymmetrical or multi-faceted configurations. As used herein, the protrusion may be substantially conical, spherical, rectangular, triangular, annular or oval.

The term "ring" as used herein will be understood to mean a continuous-loop object, it being understood that the term "ring" shall not be limited to an annular, toroidal shape. Also, while certain rings may be illustrated herein with round cross-sections, such cross-section can be any shape, such as a substantially star, triangular, oval, rectangular, or multi-sided cross-section, and may have a thickness that is solid or hollow, tubular. In addition, such rings may be any size and are of any elastic material.

The term "ring network" as used herein refers to a network of a plurality of linkers wherein the first and second ends of each linker may be configured with another end of a different linker.

The term "sheet" as used herein refers to a sheet with various thickness that may be constructed of elastomeric materials such as silicon or silicon composite. In one embodiment, the sheet is a pliable sheet. In another aspect, the sheet may be a semi-pliable, hard, or non-flexible plastic. In another embodiment, the sheet may comprise metal or wood.

The term "skirt" refers to the (planet) Saturn-ring like structure attached to the connector body and which projects radially from the center of the connector body.

The term "through slot" as used herein refers to a slot that opens on both faces of the connector body. As used herein, a through slot may also be an "aperture".

The term "slot" as used herein refers to a narrow opening on a linker or a connector body. The slot may comprise a through opening or an air hole (a "through slot") where the protrusion may be urged completely through. The slot may also be configured not to be a through opening, capable of accepting or receiving one or more protrusion, while preventing the protrusion from being dislodged easily under normal daily wearing condition and without the application of force to the slot or the protrusion.

The term "semi-sphere" as used herein refers to one half of a sphere. The sphere may be hollow spheres, semi-hollow spheres or filled spheres. In certain aspects, the hollow or semi-hollow spheres may further comprise a lip for retaining an insert or object as disclosed herein.

The term "structure" as used herein refers to the arrangement of particles or parts in a substance. In one aspect, the structure may be a construct of silicon or other elastomeric materials. In another aspect, the structure may comprise more than one linker, wherein the linkers are removably connected to each other.

The disclosure of U.S. application Ser. No. 13/589,902, filed Aug. 20, 2012 and entitled "Flexible Wearable Bands" is incorporated herein in its entirety.

It will be apparent to those skilled in the art that various modifications and variations can be made to the flexible wearable band, connecting assembly, connector body, linker and methods of the present invention without departing from the spirit or scope of the invention. Thus, it is intended that the present invention cover the modifications and variations of this invention provided they come within the scope of the appended claims and their equivalents.

What is claimed is:

1. A linker comprising a linker body having a first end and a second end;

wherein the first end is configured with a first slot;

wherein the second end is configured with a second slot;

wherein the first slot is configured to form a reversible connection with the second slot on the linker body;

wherein the slots are expandable slots; and wherein the linker and the linker body comprise of material selected from silicone or a silicone composite.

2. The linker of claim 1, wherein a plurality of the linker comprises a branched configuration.

3. The linker of claim 2, wherein the configuration is a 3-branched configuration.

4. The linker of claim 1, wherein a plurality of the linker comprises a forked configuration.

5. The linker of claim 4, wherein the configuration is a 2-forked configuration.

6. The linker of claim 1, wherein a plurality of the linker comprises a networked configuration.

7. The linker of claim 6, wherein the network is a center-lined network.

8. A linker assembly comprising at least one linker, wherein the linker comprises:

at least one linker body having a first end and a second end, wherein the first end is configured with a first slot and the second end is configured with a second slot;

a sheet comprising a first edge and a second edge;

wherein the linker body is joined length-wise along first edge of the sheet;

wherein another linker body is joined length-wise along the second edge of the sheet;

wherein the linker and the sheet comprise of material selected from silicone or a silicone composite.

9. The linker assembly of claim 8, wherein the sheet is a pliable sheet.

10. The linker of claim 9, wherein the sheet is configured to accept printing, embossing and patterning.

11. A linker assembly comprising a plurality of removable linkers, wherein the linker comprises:

at least one linker body having a first end and a second end, wherein the first end is configured with a first slot and the second end is configured with a second slot;

wherein the slots are expandable slots; and wherein the linker body is configured to receive more than one slots.

* * * * *